United States Patent [19]

Nihashi

[11] Patent Number: 4,471,819

[45] Date of Patent: Sep. 18, 1984

[54] METHOD OF, AND AN APPARATUS FOR, MAKING A FORMED WIRE

[75] Inventor: Iwao Nihashi, Toyota, Japan

[73] Assignee: Toyota Jidosha Kabushiki Kaisha, Japan

[21] Appl. No.: 430,516

[22] Filed: Sep. 30, 1982

[30] Foreign Application Priority Data

Dec. 23, 1981 [JP] Japan ..... 56-208959

[51] Int. Cl.[3] ..... B21F 45/00

[52] U.S. Cl. ..... 140/71 R; 414/225; 414/751; 72/306

[58] Field of Search ..... 140/105, 106, 71 R; 72/306, 384, 307, 420, 422; 414/222, 225, 226, 751, 416

[56] References Cited

U.S. PATENT DOCUMENTS 3,834,213 9/1974 Henzler ..... 414/225

3,993,106 11/1976 Yokota ..... 140/105

4,193,727 3/1980 Kesselring ..... 414/225

*Primary Examiner*—Francis S. Husar

*Assistant Examiner*—Linda McLaughlin

*Attorney, Agent, or Firm*—Finnegan, Henderson, Farabow, Garrett & Dunner

[57] ABSTRACT

A method for making a formed wire in a predetermined shape by merely bending a clamped wire from its opposite ends toward its center portion, unclamping the bent wire to allow release of any bending-induced tortional stresses, and rotating the bent, unclamped wire around the unbent wire axis without twisting; and an apparatus for carrying out the method, which comprises a wire support, wire a selectively operable clamp, a rotating pin wire bender for bending the clamped wire from the opposite ends to the center portion, and a chuck for locating, holding, and rotating the bent, unclamped wire around the unbent wire axis.

28 Claims, 8 Drawing Figures

Prior Art

METHOD OF, AND AN APPARATUS FOR, MAKING A FORMED WIRE

BACKGROUND OF THE INVENTION

This invention relates to a method of, and an apparatus for, making a formed wire, for example, a formed wire constituting a spring structure for a seat, bed or the like from a wire rod.

A formed wire is shown by way of example in FIG. 1. According to the conventional method, a linear wire is bent into a form spread in a plane as shown in FIG. 2; and then, portions A and B, which are called torque bars, are formed by twisting as shown in FIG. 3, whereby a formed wire having a three-dimensional shape as shown in FIG. 1 is obtained. This twisting is called "fish-mouth forming" in view of the shape of the product and it is common in the field of wire forming.

The method of making a formed wire by two steps, i.e., planar bending and fish-mouth forming, as hereinabove described, has a number of drawbacks as will hereinafter be pointed out.

Firstly, the method requires two separate machines, i.e., a planar bending machine and a fish-mouth forming machine. This leads to a high cost of facilities with necessity for correspondingly large manpower for operation. For automatic operation, a transportation apparatus, a loading apparatus and the like are required for connecting the two steps. Secondly, it is difficult to ensure accuracy in the shape of the product. Although the possibility of the springing back of the wire and the change in the shape of the formed wire due to heat treatment are taken into consideration in forming operations, there occurs a large fluctuation in the accuracy of the shape, since forming by twisting permits a high degree of elastic recovery as compared with forming by bending only.

SUMMARY OF THE INVENTION

An object of the this invention is to provide a method and apparatus for making a formed wire, said method and apparatus enabling the making of the formed wire without need for additional equipment for connecting a planar bending step and a fish-mouth forming step.

Another object of the present invention is to provide a method and apparatus for making a formed wire, said method and apparatus enabling the making of the formed wire by bending only, that is, without twisting, thereby enhancing the accuracy in shape of the formed wire.

This invention eliminates the drawbacks encountered by the conventional method, and provides a method and an apparatus for making a resilient formed wire product having a predetermined three-dimensional shape by employing a combination of simple bending steps without relying on twisting.

According to this invention, a linear wire having a given length is supported at its mid-portion by a holder, and consecutively bent from its opposite ends to its mid-portion by a pair of bending units disposed on both sides of the holder. Then, while the wire is kept in the bending means of the bending units, it is rotated by a required angle by way of a holding means of rotating units mounted on bases on which the bending units are mounted and which are adapted for operation independently of the bending units. Thereafter, the bending and rotating of the wire are repeated to obtain a desired shape of a formed wire.

These and other objects and features of the invention will be apparent upon reading of the following description of the invention in conjunction with the attached drawings with the understanding that such variations and modifications as coming within the scope of the appended claims may be easily made by those skilled in the art without departing from the spirit of the invention.

DETAILED DESCRIPTION OF THE INVENTION

The invention will now be described by way of example with reference to the drawings.

Figure 1:
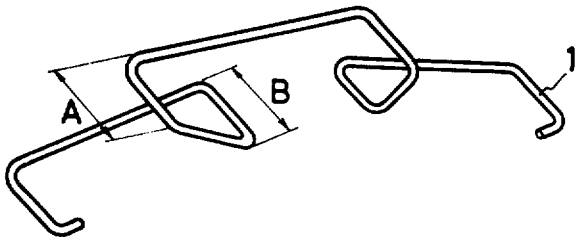
FIG. 1 is a perspective view showing a finished formed wire product by way of example.
Figure 2:
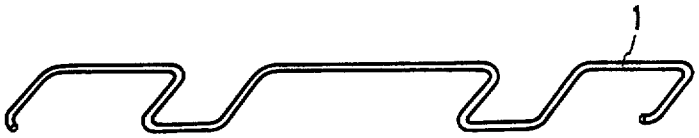
FIG. 2 is a perspective view showing an semifinished formed wire product spread in a plane made in accordance with the prior art.
Figure 3:
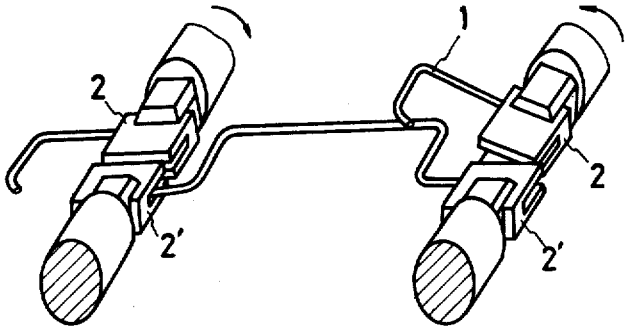
Prior Art FIG. 3
FIG. 3 is a perspective view showing the fish-mouth forming operation for a formed wire made in accordance with the prior art.
Figure 4:
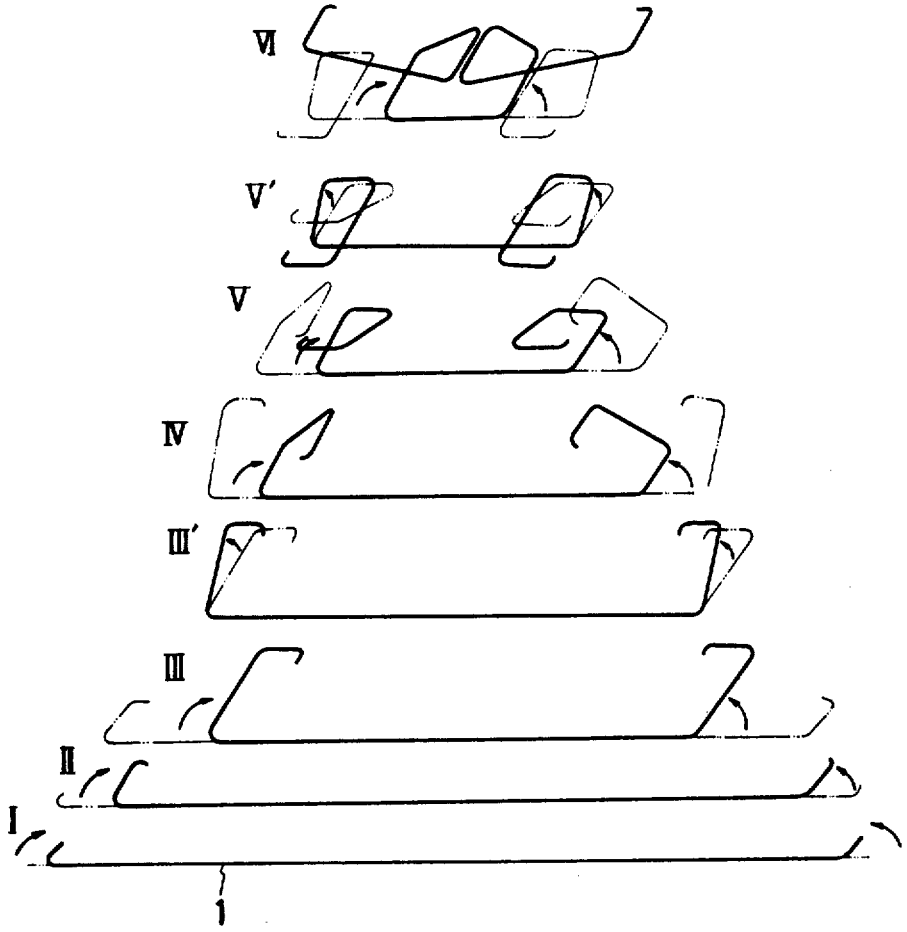
FIG. 4 is a series of views illustrating the method of this invention.
Figure 5:
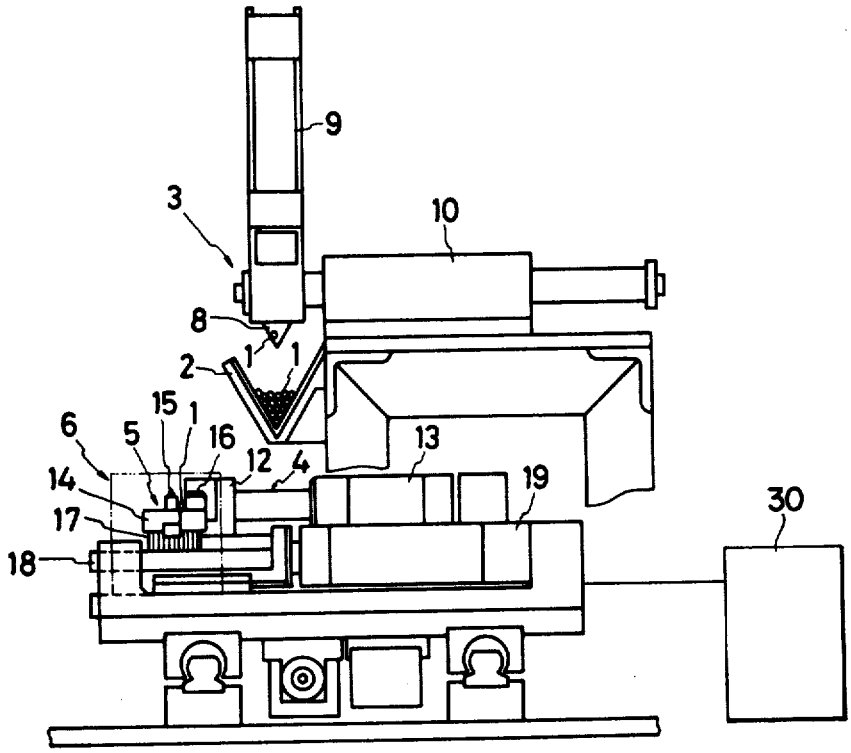
FIG. 5 is a side elevational view of a forming machine made in accordance with this invention in which a linear wire is fed in bending units.
Figure 6:
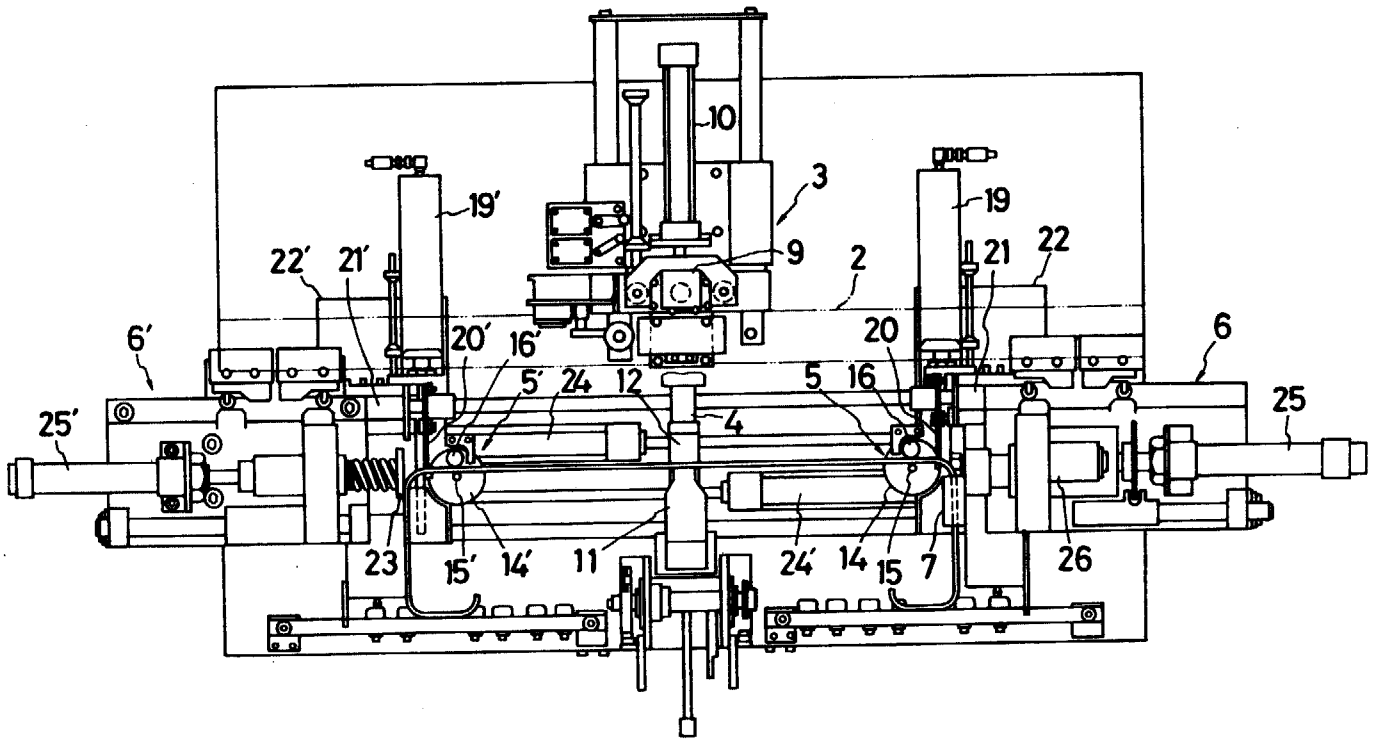
FIG. 6 is a top plan view of the machine in FIG. 5 in operation for making a formed wire.
Figure 7:
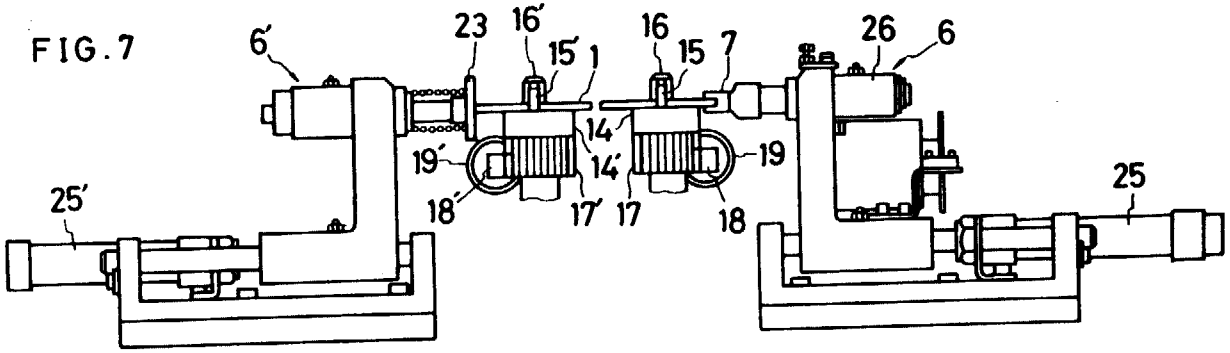
FIG. 7 is a front elevational view of a part of the machine in FIG. 5 immediately prior to the rotating operation.
Figure 8:
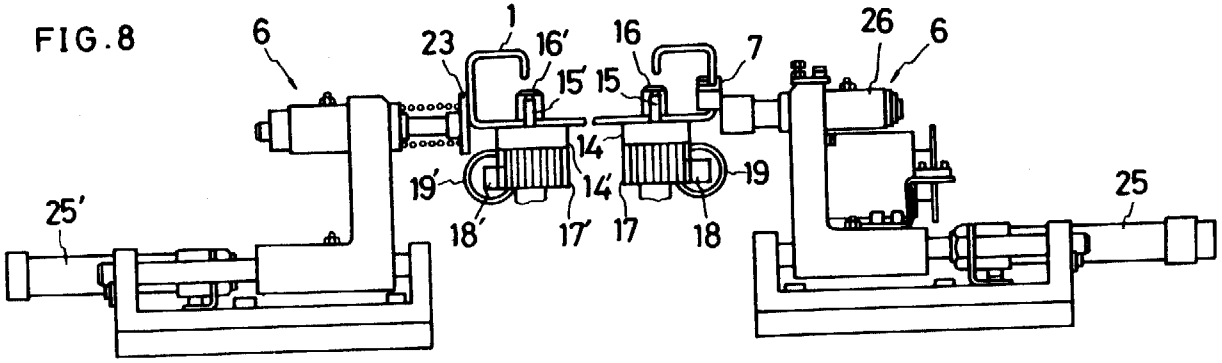
FIG. 8 is a front elevational view of a part of machine in FIG. 5 immediately after the rotating operation.

FIG. 4 illustrates a process employed according to this invention for making a formed wire as shown in FIG. 1. FIGS. 5 to 8 illustrate the process with a forming machine employed for carrying it out. FIG. 5 is a side elevational view of the forming machine in which a wire has been fed. FIG. 6 is a top plane view of the machine in which the wire has been held by rotating devices upon completion of step III, FIG. 7 is a front elevational view of the machine immediately prior to the beginning of step III', and FIG. 8 is a front elevational view of the machine immediately after the termination of step III'.

With particular reference to FIGS. 5 and 6, the forming machine is constituted as follows:

In its center is provided a loader 3 adapted to pick up and supply linear wires 1 one by one from a wire storage station 2. Below the loader 3 is disposed a holder 4 for holding a wire at its mid-portion. A pair of bending units 5 and 5' are provided on both sides of the holder 4 to bend the wire. A pair of rotating units 6 and 6' are mounted on bases 22 and 22', respectively on which the bending units 5 and 5' are mounted. The rotating units are movable independently of the bending units 5 and 5'. The rotating unit includes a holder 7 the rotatory axis of which is aligned with the longitudinal axis of the wire 1.

The loader 3 is provided at its bottom with a chuck 8 for holding the linear wire 1. A vertical hydraulic cylinder 9 having an upright shaft is provided in the loader 3 for moving the chuck 8 vertically, while a horizontal hydraulic cylinder 10 having a horizontal shaft is provided for moving the chuck 8 horizontally. The cylinder 9 is disposed immediately above the chuck 8, and the cylinder 10 behind it.

The holder 4 includes a fixed clamp support 11 disposed ahead of the wire 1 to be fed, and a movable clamp 12 disposed behind the wire 1 for holding it in a fixed position between the clamp support 11 and the clamp 12. The movable clamp 12 is connected to a clamp cylinder 13 having a forwardly movable shaft adapted to advance the clamp 12 to enable it to hold the wire 1.

Each of the bending units 5 and 5', which are disposed on both sides of the holder 4, is provided at its top with a bending device 14 or 14' adapted to hold the wire 1 and bend it. Each bending device 14 or 14' includes a forming pin 15 or 15' provided at its center, and a bending pin 16 or 16' spaced radially apart from the forming pin 15 or 15' by a distance equal to the diameter of the wire, and adapted for rotation about the forming pin 15 or 15' to bend the wire 1. Each bending device 14 or 14' is provided at its bottom with a pinion 17 or 17' engaged with a rack 18 or 18' which is connected to a bending cylinder 19 or 19'. Each bending device 14 or 14' is provided at one edge thereof with a wire width defining guide 20 or 20' which is connected to a width defining cylinder 21 or 21', and adapted for independent movement on the base 22 or 22' for the bending unit 5 or 5'.

The rotating units 6 and 6' are mounted on the bases 22 and 22' for the bending units 5 and 5', respectively, but adapted to move independently of the bending units 5 and 5', respectively. The rotating units 6 and 6' are not completely identical to each other in construction. The rotating unit 6 includes the holder 7 for holding the wire, while the rotating unit 6' is not provided with any such holder, but includes a holding plate 23. The rotation of the holder 7 is sufficient to rotate the wire, since no particularly large force is required for rotating the wire.

Each bending unit 5 or 5' is provided at its bottom with a bender moving cylinder 24 or 24' which is adapted to move the bending unit 5 or 5' with the wire width defining guide 20 or 20' and the rotating unit 6 or 6'. The guides 20 and 20', and the rotating units 6 and 6' are movable on the bases 22 and 22' for the bending units 5 and 5', respectively, to the extent defined by the dimensions of the bases 22 and 22', respectively.

The machine as hereinabove described may be utilized for making a formed wire in accordance with the steps shown in FIG. 4 as will be set forth below.

The vertical cylinder 9 in the loader 3 is actuated, such as by automatic controller 30 operatively connected to the machine as depicted schematically in FIG. 5, to lower the chuck 8 into the storage device 2 to enable it to hold a linear wire 1. The chuck 8 holding the wire 1 is raised by the cylinder 9. Then, the horizontal cylinder 10 is actuated to advance the chuck 8 to a position immediately above the bending devices 14 and 14' of the bending units 5 and 5', and the vertical cylinder 9 is actuated to lower the chuck 8, whereby the linear wire 1 is placed between the forming pins 15 and 15', and the bending pins 16 and 16' in the bending devices 14 and 14'. The chuck 8 releases the wire 1, is raised by the cylinder 9, and retracted by the cylinder 10 to its initial position in which it waits for a signal for operation to load the bending units 5 and 5' with another linear wire 1.

The width defining guides 20 and 20' for the wire 1 are moved by the cylinders 21 and 21' toward the bending devices 14 and 14' until they contact the wire. After the wire has, thus, been positioned, the movable clamp 12 is advanced by the cylinder 13 to hold the mid-portion of the wire 1 against the clamp support 11. After the guides 20 and 20' have been retracted, the cylinders 24 and 24' are actuated to move the bending devices 14 and 14' into a position in which the wire is subjected to a first step of the bending operation.

The bending cylinders 19 and 19' are actuated to advance the racks 18 and 18' to rotate the pinions 17 and 17' by a desired angle, whereby the bending devices 14 and 14' are rotated to bend the wire by an angle corresponding to the amount of rotation of the bending pins 16 and 16'. The steps shown in FIG. 4 are illustrated to bend the wire by an angle of 90°. The pins 16 are actually rotated by an angle of 90 plus $\alpha$ degrees, in which $\alpha$ indicates the angle by which the wire will spring back when bent. The angle $\alpha$ depends on the material and diameter of the wire, the radius and angle of wire rotation, etc. It is, therefore, determined by bending test on a sample wire prior to the wire forming operation. After the wire has been bent, the bending devices 14 and 14' are rotated in a reverse direction into their initial position thereby completing step I.

After the steps I to III for bending the wire have been completed, it is subjected to rotation as shown at III'. As with the above-described loading and bending steps, automatic controller 30 controls the individual components of the wire forming machine to carry out the rotation step as will be described in detail hereinafter.

Upon completion of the step III, and after the bending devices 14 and 14' have been rotated in the reverse direction into their initial position, the cylinders 24 and 24' are actuated to move the bending devices 14 and 14' into a stand-by position for the bending step IV. Then, the cylinders 25 and 25' are actuated to bring the rotating units 6 and 6' toward the wire to enable the holder 7 of the rotating unit 6 to hold the wire, while the holding plate 23 of the rotating unit 6' is pressed against the wire 1. This state is shown in top plan in FIG. 6, and in front elevation in FIG. 7.

The movable clamp 12 is retracted to release the wire 1, and the holder 7 is rotated by a motor 26 to rotate the wire 1 by a required angle. During this operation, the wire 1 is merely rotated, while no force tending to deform it is applied. After the wire has been rotated, the movable clamp 12 is advanced to hold the wire 1 against the clamp support 11. Then, the holder 7 and the holding plate 23 are retracted by the cylinders 25 and 25'.

After the rotating units 6 and 6' have been retracted, the bending devices 14 and 14' are rotated to accomplish the bending step IV. The reverse rotation of the bending devices 14 and 14' is repeated after each bending step. Upon completion of bending step V, the wire is subjected to rotation in step V' by the rotating units 6 and 6' again, and then the bending step VI is accomplished, whereby a finished formed wire 1 is finally obtained.

The foregoing description is concerned with the fabrication of a formed wire as shown in FIG. 1 in accordance with the steps shown in FIG. 4. This invention is, however, not limited to the fabrication of the formed wire having the shape shown in FIG. 1, but is applicable for making other products having various shapes merely by appropriately selecting the points at which the wire is bent, and the angles by which it is inclined.

According to this invention, a formed wire having a three-dimensional shape is made with a high degree of accuracy by repeating the simple bending of a wire progressively from its opposite ends toward its mid-portion, and rotating it by a desired angle. This method can automatically be carried out by a wire forming machine comprising bending units movable to a position for bending the wire, and rotating units including a holder having a rotatory axis of which is in alignment with the longitudinal axis of the wire, the holder being adapted to hold the wire and rotate it, while the wire stays on the bending units. Thus, a resilient product having a three-dimensional shape can be formed with a high degree of accuracy. The forming machine of this invention is economical, since it is useful for many different purposes, and does not require any other apparatus for completing all the steps of the forming operation. It ensures improved productivity, since it carries out the entire operation automatically. Controller 30 depicted in FIG. 5 can be a state of the art device, and one skilled in the automatic forming machine art could readily select or design a suitable controller component for the machine described herein given the disclosed descriptions of the sequence of operations and of the machine components.

Having thus described the invention, what is claimed as novel and described to be secured by Letters Patent of the United States is:

1. Improved apparatus for making a formed wire from a linear wire, the apparatus having means for supporting the linear wire in a plane;

means for clamping the supported wire;

means for bending a portion of the clamped wire;

means for moving the bending means along the longitudinal axis of the unbent portion of the wire; and means for rotating the wire to move the bent wire portion out of the plane, the improvement comprising:

the clamping means including means for releasing the unbent wire portion from the clamping means following activation of the bending means and before activation of the rotating means, and for reclamping the unbent wire portion of the supported wire after rotation, and the rotating means including (i) means for locating and holding the bent wire portion, (ii) means for rotating the locating and holding means a predetermined angle about the longitudinal axis of the unbent wire portion, the bent wire portion being released from the locating and holding means after the unbent portion has been reclamped and before subsequent additional bending of the unbent wire portion.

2. The apparatus of claim 1, further comprising a means for storing wires to be processed; and a means for feeding a wire from the means for storing wires to the support means.

3. The apparatus of claim 2, wherein the feeding means is provided with two hydraulic cylinders adapted for use in moving the feeding means in forward-rearward and vertical directions.

4. The apparatus of claim 3, wherein the two hydraulic cylinders include a horizontal cylinder to move the feeding means in a forward-rearward direction and a vertical cylinder to move the feeding means in a vertical direction.

5. The apparatus as in claim 1, wherein said means for locating and holding includes a chuck; means for advancing and withdrawing said chuck parallel to the longitudinal axis of the unbent wire portion; and means for selectively closing and opening said chuck for, respectively, grasping and releasing said bent wire portion.

6. The apparatus of any one of claims 1, 2, 3 or 4, wherein the clamping means comprises a set of clamps, one of which is stationary at one side of the wire and the other of which is movable and arranged on the other side of the wire, and a hydraulic cylinder which is adapted to move the movable clamp away from and toward the stationary clamp so as to hold the wire between the clamps.

7. The apparatus of claim 6, wherein the bending means include bending devices positioned on both sides of the clamping means.

8. The apparatus of claim 7, wherein the bending means comprises a base plate, a forming pin provided upright on the base plate, a bending pin which is spaced radially apart from the forming pin by a distance substantially equal to the diameter of the wire and provided upright on the base plate, and means for rotating the base plate around the forming pin, the wire being sandwiched between the forming pin and the bending pin.

9. The apparatus of claim 8, wherein the base plate rotating means comprises a rack provided on the rear side of the base plate, said rack being adapted to revolve around the axis of the forming pin, a pinion meshing with the rack, and a hydraulic cylinder to move the pinion in a forward-rearward direction.

10. The apparatus of claim 9, wherein the wire rotation means comprises a chuck for holding the bended portion of the wire adjacent the middle portion of the wire.

11. The apparatus of claim 10, wherein the bending means includes a wire width defining guide and a width defining cylinder connected thereto, said guide being adapted for independent movement from the rotation means to position the bending device.

12. The apparatus of claim 6, wherein the bending means includes a bending device comprising a base plate, a forming pin provided upright on the base plate, a bending pin which is spaced radially apart from the forming pin by a distance substatially equal to the diameter of the wire and provided upright on the base plate, and means for rotating the base plate around the forming pin, the wire being sandwiched between the forming pin and the bending pin.

13. The apparatus of claim 12, wherein the base plate rotating means comprises a rack provided on the rear side of the base plate, said rack being adapted to revolve around the axis of the forming pin, a pinion meshing with the rack, and a hydraulic cylinder to move the pinion in a forward-rearward direction.

14. The apparatus of claim 13, wherein the wire rotation means comprises a chuck for holding the part of the bended portion of the wire adjacent the middle portion of the wire.

15. The apparatus of claim 14, wherein the bending means includes a wire width defining guide and a width defining cylinder connected thereto, said guide being adapted for independent movement from the rotation means to position the bending device.

16. The apparatus of any one of claims 1, 2, 3 or 4, wherein the bending means include bending devices positioned on both sides of the clamping means.

17. The apparatus of claim 16, wherein the bending means comprises a base plate, a forming pin provided upright on the base plate, a bending pin which is spaced radially apart from the forming pin by a distance substantially equal to the diameter of the wire and provided upright on the base plate, and means for rotating the base plate around the forming pin, the wire being sandwiched between the forming pin and the bending pin.

18. The apparatus of claim 17, wherein the base plate rotating means comprises a rack provided on the rear side of the base plate, said rack being adapted to revolve around the axis of the forming pin, a pinion meshing with the rack, and a hydraulic cylinder to move the pinion in a forward-rearward direction.

19. The apparatus of claim 18, wherein the wire rotation means comprises a chuck for holding the bended portion of the wire adjacent the middle portion of the wire.

20. The apparatus of claim 19, wherein the bending means includes a wire width defining guide and a width defining cylinder connected thereto, said guide being adapted for independent movement from the rotation means to position the bending device.

21. The apparatus of any one of claims 1, 2, 3 or 4, wherein the bending means includes a bending device comprising a base plate, a forming pin provided upright on the base plate, a bending pin which is spaced radially apart from the forming pin by a distance substantially equal to the diameter of the wire and provided upright on the base plate, and means for rotating the base plate around the forming pin, the wire being sandwiched between the forming pin and the bending pin.

22. The apparatus of claim 21, wherein the base plate rotating means comprises a rack provided on the rear side of the base plate, said rack being adapted to revolve around the axis of the forming pin, a pinion meshing with the rack, and a hydraulic cylinder to move the pinion in a forward-rearward direction.

23. The apparatus of claim 22, wherein the wire rotation means comprises a chuck for holding the part of the bended portion of the wire adjacent the middle portion of the wire.

24. The apparatus of claim 23, wherein the bending means includes a wire width defining guide and a width defining cylinder connected thereto, said guide being adapted for independent movement from the rotation means to position the bending device.

25. An improved method of making a formed wire from a linear wire, the method including the steps of supporting the linear wire in a plane, clamping the linear wire in clamping means, bending at least one end portion of the linear wire toward the middle portion in the plane, rotating the wire to move the bent portion out of the plane, and bending another portion of the linear wire, the improvement comprising:

the additional step of releasing the linear wire from the clamping means while maintaining planar support for the wire, said releasing step being accomplished after the bending step and before the rotating step, the improvement further comprising the rotating step having the substeps of (i) locating the bent wire portion, (ii) holding the bent wire portion in a rotatable fixture, (iii) rotating the holding fixture by a predetermined angle about the longitudinal axis of the unbent wire portion, (iv) re-clamping the unbent wire portion in the clamping means, and (v) releasing the bent wire portion from the holding fixture.

26. The improved method as in claim 25 wherein said locating substep includes moving the holding fixture to engage the bent wire portion.

27. The improved method as in claim 25 wherein said clamping step includes clamping the linear wire at the middle portion.

28. The improved method as in claim 25 wherein said bending step includes bending both linear wire end portions towards the middle portion.

* * * * *